US005590530A

United States Patent [19]

Owen et al.

[11] Patent Number: 5,590,530

[45] Date of Patent: Jan. 7, 1997

[54] FUEL AND AIR MIXING PARTS FOR A TURBINE COMBUSTION CHAMBER

[75] Inventors: Ashley J. Owen; Michael L. Carlisle; Christopher S. Parkin, all of Derby, England

[73] Assignee: Rolls-Royce plc, London, England

[21] Appl. No.: 404,151

[22] Filed: Mar. 14, 1995

[30] Foreign Application Priority Data

Apr. 8, 1994 [GB] England ..... 9407029

[51] Int. Cl.[6] ..... F02C 7/00

[52] U.S. Cl. ..... 60/748; 60/752

[58] Field of Search ..... 60/39.36, 760, 60/748, 750, 758, 759, 755, 737, 752; 431/117, 175

[56] References Cited

U.S. PATENT DOCUMENTS

| | | | |
|---|---|---|---|
| 3,134,229 | 5/1964 | Johnson . | |
| 3,643,430 | 2/1972 | Emory, Jr. et al. | 60/748 |
| 3,811,278 | 5/1974 | Taylor et al. . | |
| 3,874,169 | 1/1975 | Andersson . | |
| 4,301,657 | 11/1981 | Penny | 60/759 |

FOREIGN PATENT DOCUMENTS

| | | |
|---|---|---|
| 506516 | 9/1992 | European Pat. Off. . |
| 2106485 | 5/1972 | France . |
| 2406726 | 5/1979 | France . |
| 904255 | 11/1951 | Germany . |
| 685068 | 12/1952 | United Kingdom . |
| 736823 | 9/1955 | United Kingdom . |
| 1511849 | 5/1978 | United Kingdom . |
| 2020371 | 11/1979 | United Kingdom . |
| 2099978 | 12/1982 | United Kingdom . |

*Primary Examiner*—Louis J. Casaregola
*Attorney, Agent, or Firm*—Cushman Darby & Cushman, IP Group of Pillsbury, Madison & Sutro LLP

[57] ABSTRACT

An annular combustion chamber for a gas turbine engine is provided with a plurality of fuel injection nozzles at its upstream end to direct swirled flows of fuel and air into the chamber. Ports in the combustion chamber walls direct air into the combustion chamber to oppose the swirling fuel and air flows from the fuel injection nozzles to achieve better fuel and air mixing.

4 Claims, 1 Drawing Sheet

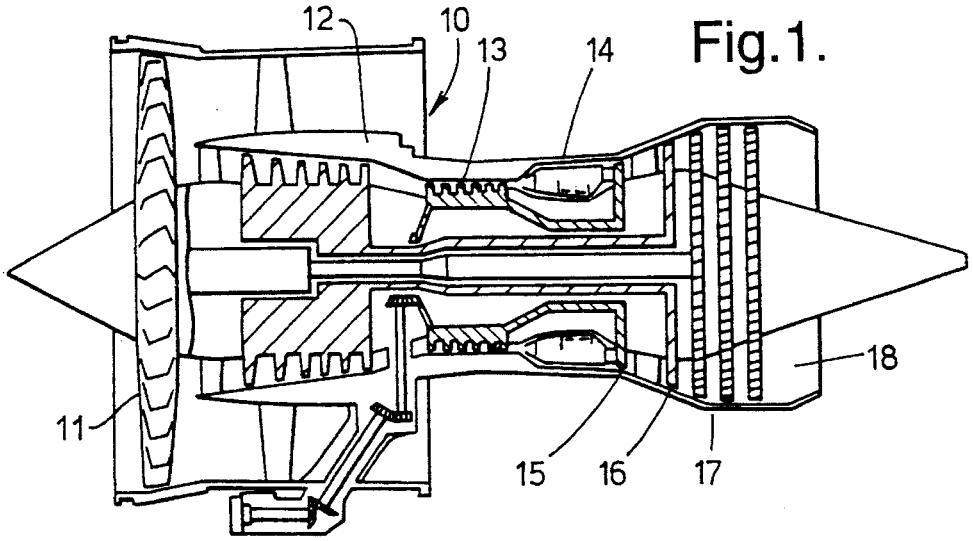
Fig.1.
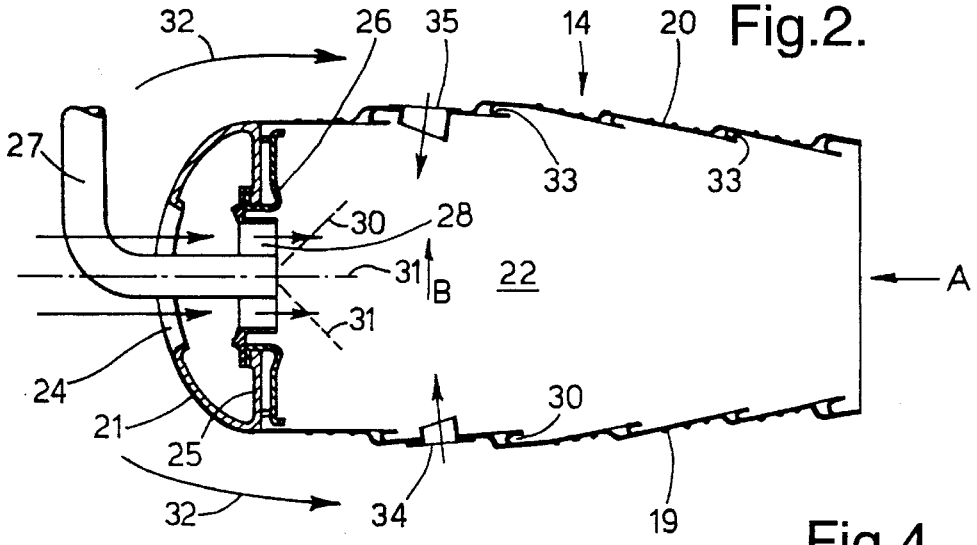
Fig.2.
Fig.3.
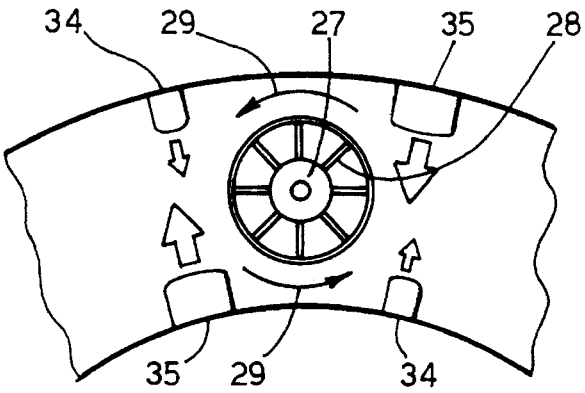
Fig.4.
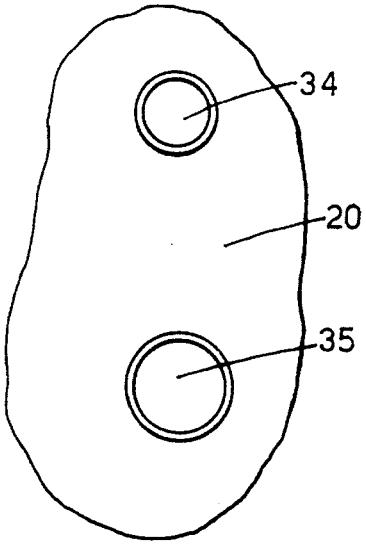

FUEL AND AIR MIXING PARTS FOR A TURBINE COMBUSTION CHAMBER

FIELD OF THE INVENTION

This invention relates to combustion apparatus for a gas turbine engine and is particularly concerned with the efficient mixing of fuel and air in such combustion apparatus.

BACKGROUND OF THE INVENTION

The combustion apparatus of a gas turbine engine is required to operate over a wide range of conditions. It is important that throughout this range of operating conditions, the fuel and air mixture which is directed into the apparatus is as thoroughly mixed as possible. If such thorough mixing is not achieved, then following combustion of the mixture, zones of combustion products will appear which are hotter than the remainder of the combustion products. This gives rise to variations in the temperature distribution of the combustion products as they exit the combustion apparatus. As a direct consequence of this, the nozzle guide vanes and other parts of the turbine which normally lie downstream of the combustion apparatus are subjected to localised overheating.

Conventionally, the parts of the turbine which lie downstream of the combustion apparatus are provided with internal cooling air passages in order to ensure that they do not overheat. However, in order to cope with the localised overheating which can result from poor fuel and air mixing, the cooling air flow to the turbine parts is higher than would otherwise be the case. This in turn has a prejudicial effect upon overall engine efficiency. A further problem associated with such localised overheating is that it can have a detrimental effect upon turbine component life.

SUMMARY OF THE INVENTION

It is an object of the present invention to provide a gas turbine engine combustion apparatus in which the efficiency of fuel and air mixing is improved, thereby reducing the occurrence of localised hot-spots in the combustion products exhausted from the combustion apparatus.

According to the present invention, a gas turbine engine combustion apparatus comprises an annular combustion chamber having a plurality of fuel nozzles at its upstream end to direct a mixture of fuel and air into said chamber, each of said fuel nozzles being adapted to swirl the fuel and air mixture directed therefrom in a given direction about its longitudinal axis, said combustion chamber being defined by radially inner and outer generally axially extending annular walls, each of said radially inner and outer walls being provided with ports, at least in the upstream region thereof, for the entry of air into said combustion chamber, said ports being arranged in circumferentially extending arrays so that the ports in each array define circumferentially alternate sources of high and low pressure air, the or each array of said ports in said radially outer combustion chamber wall being aligned with a corresponding array of said ports in said radially inner combustion chamber wall so that each port defining a source of pressurized air in one of said combustion chamber walls opposes a port which defines a source of pressurized air, in the other of said combustion chamber walls, said ports being so positioned that air is exhausted from said ports defining sources of high pressure air in such directions that it opposes said given direction of swirl of said fuel and air mixture directed from each of said fuel nozzles.

BRIEF DESCRIPTION OF THE DRAWINGS

The present invention will now be described, by way of example, with reference to the accompanying drawings in which:

FIG. 1 is a sectioned side view of a ducted fan gas turbine engine which includes combustion apparatus in accordance with the present invention.

FIG. 2 is a sectioned side view on an enlarged scale of a part of the combustion apparatus of the ducted fan gas turbine engine shown in FIG. 1.

FIG. 3 is a view on arrow A of FIG. 2 showing the upstream end of the combustion apparatus.

FIG. 4 is a view on arrow B of FIG. 2 showing part of the wall of the combustion apparatus.

DETAILED DESCRIPTION OF THE INVENTION

With reference to FIG. 1, a ducted fan gas turbine engine generally indicated at 10 is of conventional overall configuration and operation. Thus air drawn in by a fan 11 at the upstream end of the engine is compressed by two axial flow compressors 12 and 13 before being directed into combustion apparatus 14 in accordance with the present invention. There the compressed air is mixed with liquid fuel and the mixture combusted. The resultant hot combustion products then expand through a series of turbines 15, 16 and 17 before being exhausted through a propulsive nozzle 18.

The combustion apparatus 14 can be seen more clearly if reference is now made to FIG. 2. The combustion apparatus 14 is of the annular type. It comprises two generally axially extending, radially spaced apart annular cross-section walls 19 and 20 which are interconnected at their upstream ends by a curved wall 21. The downstream ends of the combustion apparatus walls 19 and 20 are connected to an annular array of nozzle guide vanes (not shown) which constitute the upstream end of the first turbine 15. The walls 19, 20 and 21 thereby define a combustion chamber 22.

Compressed air exhausted from the compressors 12 and 13 is directed to a region 23 immediately upstream of the combustion apparatus 14. Some of that air passes through a plurality of apertures 24 provided in the curved wall 21. Immediately downstream of the curved wall 21 there is provided a further wall 25 which is also apertured to provide a series of further apertures 26 which are aligned with the apertures 24 in the curved wall 21.

The apertures 26 in the further wall 25 each receive the downstream end of a generally L-shaped fuel nozzle 27 which also passes through an aperture 24 in the curved wall. The fuel nozzle 27 downstream end is provided with an annular array of swirler vanes 28, which can also be seen in FIG. 3. The assembly of swirler vanes 28 actually interconnects the fuel nozzle 27 downstream end and the further wall 25.

The air which passes through the apertures 24 in the curved wall 21 is subsequently swirled by the swirler vanes 28 in a generally anti-clockwise direction when viewed in the upstream direction and as indicated by the arrows 29 in FIG. 3. This swirling of the air flow promotes mixing of the air with fuel which is sprayed in a conical jet 30 from the downstream end of the fuel nozzle 27. Consequently a swirling flow of fuel and air is created which swirls about the longitudinal axis 31 of the fuel nozzle 27.

Unfortunately the swirling flows of fuel and air which are created by the fuel nozzles 27 are not fully effective in providing thorough mixing of the fuel and air. In order to remedy this, additional flows of air are directed into the combustion chamber 22. The air originates from the region 23 and flows around the exterior of the combustion chamber 22 as indicated by the arrows 32 so that it cools the combustion chamber walls 19 and 20 as it flows over them. Some of the air then flows into the combustion chamber 22 through a plurality of small inlets 33 provided in the combustion chamber walls 19 and 20. These air flows provide further combustion chamber wall 19 and 20 cooling as well as additional air to assist in the combustion process which takes place within the combustion chamber 22.

The remainder of the air flows into the combustion chamber 22 through a series of small and large diameter ports 34 and 35 respectively which are provided in the combustion chamber walls 19 and 20. More specifically, each of the combustion chamber walls 19 and 20 is provided with an annular array of the ports 34 and 35 towards its upstream end. Each port 34 and 35 is in the form of a short open ended pipe which protrudes into the combustion chamber 22. The end of each port 34 and 35 which protrudes into the combustion chamber 32 is scarfed. Each annular annular array of ports 34 and 35 comprises circumferentially alternate small and large diameter ports 34 and 35, one of each of which can be seen in plan view in FIG. 4. The ports 34 and 35 in each of the combustion chamber walls 19 and 20 are so positioned that they oppose each other so that one small diameter port 34 opposes a large diameter port 35. This can be seen most clearly in FIG. 3.

The ports 34 and 35 are so positioned circumferentially in the walls 19 and 20 that the high pressure air exhausted from the larger ports 35 tends to oppose the direction of swirl of the fuel and air mixture from the fuel nozzles 27. FIG. 3 shows this effect with the size of the arrows associated with the ports 34 and 35 being proportional to the pressure of the air exhausted from those ports 34 and 35. This results in highly effective mixing of the fuel and air within the combustion chamber 22 prior to their combustion which leads in turn to a reduction in the magnitude of the thermal gradients which occur at the downstream end of the combustion chamber 22. The cooling requirements of the turbine 15 immediately downstream of the combustion chamber 22 are consequently less demanding than would otherwise be the case.

The flows of low pressure air exhausted from the small diameter ports 34 are necessary to ensure that the high pressure air flows from the large diameter ports 35 which they oppose do not direct hot combustion products on to the combustion chamber walls 19 and 20. If this did occur, there would be very rapid overheating, and consequent failure, of the combustion chamber walls 19 and 20.

It will be appreciated that although the present invention has been described with reference to a gas turbine engine combustion chamber 22 which is provided with a single annular array of ports 34 and 35 in its radially inner and outer walls 19 and 20, further more downstream annular arrays of such ports 34 and 35 could be provided if so desired in order to ensure thorough fuel and air mixing. The ports 34 and 35 in such additional arrays would, of course, have to be in appropriate positional relationship with the fuel nozzles 27 and with each other in order to create the desired effect of thorough fuel and air mixing.

We claim:

1. A gas turbine engine combustion apparatus comprising an annular combustion chamber having an upstream end and a plurality of fuel nozzles at said upstream end to direct a mixture of fuel and air into said chamber, each of said fuel nozzles defining a longitudinal axis and being configured so as to swirl the fuel and air mixture directed therefrom in a given direction about said longitudinal axis, said combustion chamber being defined by radially inner and outer generally axially extending annular walls, each of said radially inner and outer walls being provided with ports at least in an upstream region thereof, for the entry of air into said combustion chamber, said ports being arranged in circumferentially extending arrays with a radially inner located port being substantially aligned with a radially outwardly located port and spaced apart circumferentially so that one of said radially inner and one of said radially outer located ports are disposed substantially on opposite sides of a said longitudinal axis, at least some of said array of ports being of different diameters and arranged such that a port of smaller diameter is radially substantially aligned with a port of larger diameter located radially outwardly thereof in said radially outer combustion chamber wall so that the air exhausted from said arrays of ports opposes said given direction of swirl of said fuel and air mixture directed from each of said fuel nozzles.

2. A gas turbine engine combustion apparatus as claimed in claim 1 wherein each of said fuel nozzles comprises means adapted to direct a substantially conical jet of fuel into said combustion chamber and an annular array of swirler vanes positioned around said fuel directing means to provide swirling of said fuel with the flow of air through said swirler vanes.

3. A gas turbine engine combustion apparatus as claimed in claim 1 wherein each of said ports is in the form of a short open ended pipe protruding into said combustion chamber.

4. A gas turbine engine combustion apparatus as claimed in claim 3 wherein each of said short open pipes is scarfed on the end thereof protruding into said combustion chamber.

* * * * *